United States Patent [19]

Gibson et al.

[11] 4,366,864

[45] Jan. 4, 1983

[54] METHOD FOR RECOVERY OF HYDROCARBONS FROM OIL-BEARING LIMESTONE OR DOLOMITE

[75] Inventors: Michael A. Gibson, Houston; Robert E. Pennington; George T. Arnold, both of Baytown, all of Tex.

[73] Assignee: Exxon Research And Engineering Co., Florham Park, N.J.

[21] Appl. No.: 209,560

[22] Filed: Nov. 24, 1980

[51] Int. Cl.[3] ..... E21B 43/247

[52] U.S. Cl. ..... 166/259; 166/261; 166/266; 166/299

[58] Field of Search ..... 299/2, 4, 13; 166/256, 166/261, 259, 266, 271, 272, 299

[56] References Cited

U.S. PATENT DOCUMENTS

| | | | |
|---|---|---|---|
| 3,001,775 | 9/1961 | Allred | 166/259 X |
| 3,233,668 | 2/1966 | Hamilton et al. | 166/259 |
| 3,465,819 | 9/1969 | Dixon | 166/247 |
| 3,993,132 | 11/1976 | Cram et al. | 166/261 |
| 3,999,607 | 12/1976 | Pennington et al. | 166/259 |
| 4,059,152 | 11/1977 | Allen et al. | 166/261 |
| 4,140,181 | 2/1979 | Ridley et al. | 166/267 |
| 4,171,146 | 10/1979 | Hard | 299/4 X |
| 4,185,693 | 1/1980 | Crumb et al. | 166/259 |

*Primary Examiner*—James A. Leppink
*Assistant Examiner*—George A. Suchfield
*Attorney, Agent, or Firm*—Yale S. Finkle

[57] ABSTRACT

Hydrocarbon liquids and/or gases are recovered from thick underground deposits of oil-bearing limestone or dolomite by drilling two or more boreholes from the earth's surface into the lower part of the deposit, establishing communication between the boreholes, burning the oil in said limestone or dolomite in an area between the boreholes to decompose the alkaline earth carbonate into alkaline earth oxide, flushing out the alkaline earth oxide formed by the combustion with water to form a cavity, collapsing the overlying oil-bearing limestone or dolomite into the cavity to form a rubblized zone extending vertically to a point near the upper boundary of the deposit, driving a flame front vertically through the rubblized zone to liberate hydrocarbon liquids and produce gases, and recovering the liquids and/or gases from the rubblized zone.

12 Claims, 3 Drawing Figures

METHOD FOR RECOVERY OF HYDROCARBONS FROM OIL-BEARING LIMESTONE OR DOLOMITE

BACKGROUND OF THE INVENTION

This invention relates to the recovery of hydrocarbons from oil-bearing deposits of limestone and dolomite and is particularly concerned with an in situ recovery process which permits the recovery of hydrocarbon liquids in substantial quantities.

A large amount of oil exists today in the United States trapped in deposits of limestone located throughout the country. The current shortage of oil has made it highly desirable to recover the liquid hydro-carbons from these deposits. It has been suggested that conventional methods of steam stimulation used in the past with success in recovering oil from tight formations of sand be applied in an attempt to recover heavy oil from limestone deposits. Such methods normally include drilling a series of several boreholes into the formation around a central borehole and injecting high pressure steam into the central borehole. The heat from the steam moves by conduction and convection outward from the central borehole decreasing the viscosity of the trapped oil and forcing it toward the other bore-holes from which it is eventually recovered. Attempts to apply such methods for recovering the oil from limestone deposits in Southwest Texas, however, have proven ineffective evidently because the viscosity of the oil is so great and the permeability of the formations so low that it is impossible to force the oil or the steam through the limestone. Thus, at this time, there appears to be no commercially feasible process for the in situ recovery of heavy oil from such limestone deposits.

SUMMARY OF THE INVENTION

The present invention provides an in situ process which permits the effective recovery of hydrocarbons from underground deposits of oil-bearing limestone and dolomite. In accordance with the invention, it has now been found that hydrocarbon liquids and gases can be recovered from such deposits by drilling at least two boreholes from the earth's surface into the lower part of the deposit, establishing communication between at least two boreholes near the lower boundary of the deposit, combusting the oil in the deposit between the two boreholes until a sufficient amount of the alkaline earth carbonate in the deposit is decomposed into alkaline earth oxide occupying a space equivalent to from about 5 to about 30 percent of the volume of the deposit, contacting the alkaline earth oxide thus formed with water introduced into one of the boreholes thereby disintegrating the alkaline earth oxide and forming an aqueous slurry containing alkaline earth hydroxide, withdrawing the slurry of alkaline earth hydroxide through another of the boreholes thereby creating a cavity in the deposit having a volume equivalent to from about 5 to about 30 percent of the volume of the deposit, collapsing the oil-bearing limestone or dolomite overlying the cavity to form a rubblized zone extending vertically to a point near the upper boundary of the deposit, driving a flame front through the rubblized zone to liberate hydrocarbon liquids and produce gases, and recovering the liquids and gases from the rubblized zone.

The process of the invention is based at least in part upon the discovery that large chunks of oil-bearing limestone such as the Anacacho limestone of Southwest Texas, can be disintegrated into much smaller pieces by heating the limestone to decompose the calcium carbonate into calcium oxide and carbon dioxide and then contacting the resultant chunks of calcium oxide with water. It has been found that upon contact with water the large chunks of calcium oxide formed by thermal decomposition will disintegrate into small pieces without mechanical agitation or grinding. This discovery makes it possible to create large underground cavities in oil-bearing limestone into which the over-lying deposit can be broken down and subsequently pyrolyzed to produce liquids and gases. Absent this discovery, it would be impossible to create such a cavity by burning the oil in the limestone to decompose the calcium carbonate, since the resultant calcium oxide would remain structurally intact.

The process of the invention provides an effective and economical in situ method of recovering hydrocarbon liquids and gases from formations of oil-bearing limestone and dolomite which avoids the problems encountered when using conventional thermal methods that have in the past been successful in producing oil from similar type formations.

DESCRIPTION OF THE PREFERRED EMBODIMENTS

Figure 1:
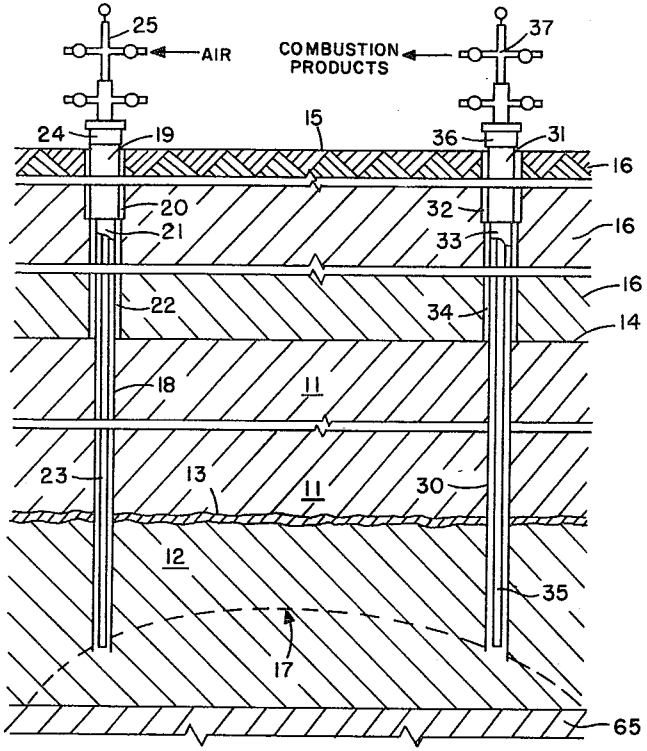
FIG. 1 in the drawing is a schematic diagram showing a vertical cross section through an underground deposit of oil-bearing limestone and the overlying formations during the early stage of an operation for the recovery of liquids from the limestone carried out in accordance with the invention.

The geological section depicted in FIG. 1 of the drawing is one in which a relatively thick seam of oil-bearing limestone 11 and a somewhat thinner seam of similar oil-bearing limestone 12 are separated by a thin barrier of slate 13 to give a total thickness of at least about 30 feet. The upper boundary of the upper seam 11 is overlain by sandstones, barren limestones, and other type formations 16 which extend downward from the earth's surface 15 and prevent communication between any overlying aquifer and the deposit of oil-bearing limestone. Below the lowermost of the two seams are relatively impermeable formations 65. Although the geological section depicted is one which is particularly well suited for carrying out the process, it will be understood that the invention is not restricted to such a section and is applicable to any of a variety of other oil-bearing limestone or dolomite deposits whether or not separated by slate or other types of rock. It will also be understood that the process of the invention is normally applicable to recovering hydrocarbons from limestone and dolomite deposits which contain oil that is normally solid at ambient deposit temperatures.

In carrying out the process of the invention, a vertical borehole 18 is first drilled from the earth's surface into the lower part of the oil-bearing limestone deposit by conventional methods. This borehole will normally be equipped with a string of large diameter casing or surface pipe 19 which extends to a depth below any aquifers near the surface and thus serves, among other things, to prevent the contamination of surface water supplies. The surface pipe is cemented in place in the conventional manner as indicated by reference numeral 20. Extending downward through the surface pipe is an intermediate string of casing 21 which is also cemented in place, the cement being designated by reference numeral 22. In the installation shown in FIG. 1, this intermediate casing string extends to the top 14 of oil-bearing limestone deposit 11. An inner pipe or tubing string 23 extends downward through the outer and intermediate casing strings to a point near the bottom of the borehole. The casing hangers and other equipment used to suspend the pipe within the hole do not appear in the drawing. The actual casing arrangement within the borehole will depend in part upon the depth of the oil-bearing limestone seam, the nature of the overlying strata, the manner in which the in situ operation is to be carried out and the like, and may be varied as necessary. A conventional wellhead 24 and Christmas tree 25 fitted with a plurality of lines and valves through which fluids may be injected or produced from the central pipe or tubing string and the annular passages surrounding it has been installed as shown in the drawing. The particular type of well head and Christmas tree employed will normally depend in part upon the casing within the borehole and the manner in which the particular operation is to be conducted. Equipment normally used in the petroleum industry will ordinarily be suitable.

The process of the invention may be initiated with two or more boreholes. In the operation shown in FIG. 1, an initial borehole has been drilled and cased as described above and a second borehole 30 has later been drilled from an offset location on the earth's surface to a point at about the same depth in the oil-bearing limestone formation as borehole 18. The second borehole is equipped with surface pipe 31 which is cemented in place as indicated by reference numeral 32, with an intermediate casing string 33 surrounded by cement 34 extending to the top of oil-bearing limestone seam 11, and with a central tubing string 35 which extends downward through the surface pipe and intermediate casing string to a point near the bottom of oil-bearing limestone seam 12. In some cases it may be advantageous to extend the intermediate casing string into the oil bearing limestone zone and cement it in place within the limestone to help protect the pipe during later operations. A wellhead 36 and Christmas tree 37, which may be similar to those used with borehole 18, have been installed. Again it will be understood that the process is not restricted to the particular borehole arrangement depicted in FIG. 1 and that other arrangements may be employed.

Following the drilling of two or more boreholes into the lower part of the oil-bearing limestone seam as described above, the boreholes are linked and the oil in the limestone between the boreholes is combusted. Where two boreholes are used as illustrated in FIG. 1, communication between the two boreholes can be established by injecting air or gas into one borehole under sufficiently high pressure to fracture the limestone between the two holes, by hydraulic fracturing between the boreholes, by detonating directional or other explosive charges in one or both boreholes, by directional drilling or by other conventional means. Once this has been done, combustion can then be started near the bottom of one borehole by injecting a small quantity of a liquid fuel such as heavy naphtha or kerosene into the bottom of the borehole, circulating air to the bottom of the hole through the central tubing string and back to the surface through the surrounding annulus, and then actuating an electrical ignitor lowered into the bottom of the hole through the tubing string while continuing the flow of air. An alternate procedure is to introduce hypergolic components, highly unsaturated hydrocarbons and fuming nitric acid or other strong oxidizing agents, for example, into the borehole separately and allow them to contact and react with one another at the bottom of the hole. Another procedure which may be used is to circulate oxygen into the bottom of the hole until the oil in the limestone begins to combust spontaneously. Still other ignition procedures which can be employed will suggest themselves to those skilled in the art. Once combustion has been started it is continued by injecting air or oxygen into one of the boreholes and withdrawing combustion products from the other.

After combustion has been initiated, which can be determined by monitoring the temperature and composition of gases withdrawn from the oil-bearing limestone seam or by means of thermocouples or the like, air, oxygen enriched air, or oxygen is injected through the tubing string of one borehole and combustion products are withdrawn through the tubing string of the other. Steam may also be injected to aid in controlling combustion if desired. It is normally preferred to employ two boreholes and to inject air or other oxygen-containing gas through tubing string 23 in borehole 18. It is also normally preferred to begin the combustion of the oil in the limestone at the bottom of one borehole while injecting the oxygen-containing gas through the tubing string of the other borehole and withdrawing the combustion products through the tubing string of the borehole in which the combustion was initiated. This process of reverse combustion is normally preferred over forward combustion, where the oxygen-containing gas is injected through the tubing string of the borehole in which the combustion was initiated, because the hot combustion gases pass over burned-out limestone instead of oil-bearing limestone as they move toward the production borehole. Thus, there is no possibility that the hot gases can pyrolyze or crack and distill oil which can then condense upflow of the flame front and plug the link between the wells.

As the oil in the limestone burns, it generates heat which in turn causes the limestone or calcium carbonate to decompose into calcium oxide and carbon dioxide. The amount of oxygen in the oxygen-containing gas injected into one of the boreholes to support combustion and the pressure of that injected gas are normally controlled so that thermodynamics favor the decomposition of the calcium carbonate. Normally, the combustion is carried out at a temperature above about 1300° F. The combustion is continued until a substantial volume of the calcium carbonate has been decomposed near the bottom of the seam as illustrated by dashed line 17 in FIG. 1. The volume of the decomposed area will depend in part upon the height and depth of the oil-bearing limestone seam, the number and thickness of the shale breaks, slate, or other noncombustible zones, if any, within the body of the oil-bearing limestone, the character of the overburden, the composition of the oil-bearing limestone itself and the like. In general, it is preferred to burn enough of the oil to create a zone of calcium oxide at the bottom of the oil-bearing limestone seam equivalent in size to from about 5 to about 30 percent of the volume of the oil-bearing limestone overlying an area of from about one-fourth to about two acres in the vicinity of the linked boreholes. In deep thick seams, a somewhat larger volume of decomposed limestone may be created than would normally be produced in a relatively shallow thin seam. In a deep seam having a thickness of about 200 feet, it is normally adequate if enough oil in the limestone is burned to produce a zone of calcium oxide that has a radius of about 100 feet and thus corresponds to a surface area of about three-fourths of an acre between the two boreholes. In a thicker formation, a calcium oxide zone of a somewhat larger size may be preferable.

It has been found that the zone of decomposed limestone created by the burning of the oil trapped in the pores of the limestone will retain its original volume instead of disintegrating to form a cavity or void volume in the oil-bearing limestone deposit in which the required rubblized zone can be created. The process of the invention is based at least in part upon the discovery that the calcium oxide created from decomposition of calcium carbonate with simultaneous generation of carbon dioxide can be disintegrated without the use of any mechanical agitation or grinding by simply contacting the calcium oxide with water. The water breaks up large chunks of the calcium oxide into smaller pieces of calcium hydroxide and can be used to flush the calcium hydroxide away in a slurry form thus creating the necessary void volume or cavity required for effectively carrying out the process of the invention.

Figure 2:
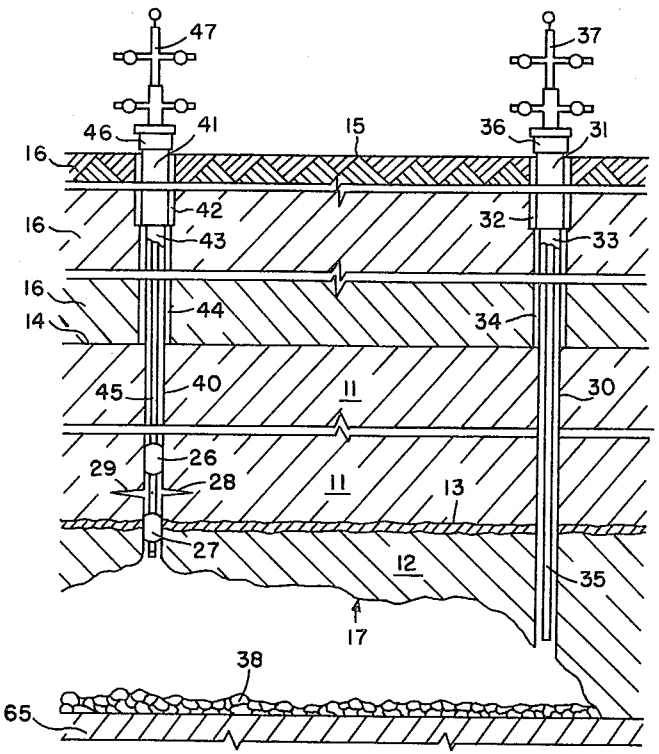
FIG. 2 is a drawing illustrating the right side of the oil-bearing limestone deposit and overlying formations of FIG. 1 during a later stage of the process.

Referring again to FIG. 1 of the drawing, after the zone of calcium oxide, defined by dashed line 17, is created by burning the oil present in the limestone, the injection of combustion air or other oxygen-containing gas into the seam through the injection borehole is terminated. Thereafter, water is injected into borehole 18 and passed in contact with the decomposed limestone in the area designated by dashed line 17. The decomposed limestone disintegrates as it comes in contact with the water injected through borehole 18 and an aqueous slurry of calcium hydroxide is formed. The resultant slurry is withdrawn from the seam through borehole 30. The water is injected through borehole 18 at a rate sufficient to flush out or remove the majority of the calcium oxide which was formed during the combustion procedure described above. The aqueous slurry of calcium hydroxide withdrawn through borehole 30 is passed to a settling tank, not shown in the drawing, where the solids in the slurry are allowed to settle. The water in the settling tank from which a majority of the solids has settled may then be reused to flush out calcium hydroxide from the burned out portion of the limestone deposit. A portion of the cavity thus created is illustrated in FIG. 2 of the drawing. This figure is an enlarged section of the right portion of FIG. 1 which depicts borehole 30 but does not show borehole 18. Thus, only the right hand portion of the cavity created by injecting water through borehole 18 in FIG.1 is shown in FIG. 2.

After a cavity of desired volume has been created in the manner described above, injection of water into the seam through injection borehole 18 is terminated. Thereafter, the oil-bearing limestone overlying the cavity is broken down into the cavity to form a rubblized zone of high permeability extending vertically over substantially the entire extent of the seam. This may be done by hydraulic or pneumatic fracturing, by explosive fracturing or the detonation of explosive charges. In order to facilitate the creation of the rubblized zone, it is preferable to drill a third borehole approximately midway between the two boreholes used to create the cavity in the oil-bearing limestone deposit. This third borehole is depicted in FIG. 2 by reference numeral 40 and is equipped with surface pipe 41 which is cemented in place as indicated by reference numeral 42, with an intermediate casing string 43 surrounded by cement 44 extending to the top of oil-bearing limestone seam 11, and with a central tubing string 45 which extends downward through the surface pipe and intermediate casing string to a point near the top of the cavity whose boundary is designated by line 17. A wellhead 46 and Christmas tree 47, which may be similar to those used with boreholes 18 and 30 have been installed.

If hydraulic or pneumatic fracturing is to be employed to create the rubblized zone, tubing string 45 is fitted with packers 26 and 27 and with a valve or closure at its lower end and run into borehole 40. Depending upon the particular type of packer employed, the packers may be set either mechanically or hydraulically. This effects a seal between the outer surface of the tubing string and the surrounding wall of the borehole at each packer. Once this has been done, a perforating tool is lowered through the tubing string into position between the packers. The tool may be of either the shaped charge or bullet type. This tool can then be fired to create perforations in the tubing between the packers and penetrate the adjacent oil-bearing limestone faces as indicated by reference numerals 28 and 29. Other packer and tubing arrangements, some of which may not require perforations of the tubing string, can also be employed. After the perforations have been formed, the oil-bearing limestone can be broken down by injecting air or inert gas or a hydraulic or explosive fracturing liquid through the tubing string and perforations into the annular space between the packers and the surrounding limestone. If desired, a similar perforating and fracturing operation can be carried out in boreholes 18 and 30 to assist in breaking down the oil-bearing limestone so that it will fall as solids 38 onto the floor of the cavity below. Any stringers of slate or other material imbedded in the oil-bearing limestone, such as slate layer 13, will be broken down with the limestone. The presence of such material is often advantageous in that it later serves to break up flow patterns within the rubblized zone and thus discourage channeling. The perforating and fracturing operation may be carried out as many times as necessary until the oil-bearing limestone below upper boundary 14 has been broken down and a rubblized zone extending over substantially the entire extent of the seam has been formed between boreholes 18 and 30.

In lieu of breaking down the oil-bearing limestone by fracturing as described above, the lime-stone can also be broken down by pulling the tubing string 45 out of borehole 40, lowering a series of shaped explosive charges into the open borehole below intermediate casing string 43, and then detonating the shaped charges in sequence. Nondirectional charges can also be detonated in the open borehole to break down the limestone if desired. Here again, the breaking down operation can also be carried out in borehole 18 and borehole 30 to increase the amount of limestone broken down and thus increase the size of the resulting rubblized zone if desired.

Figure 3:
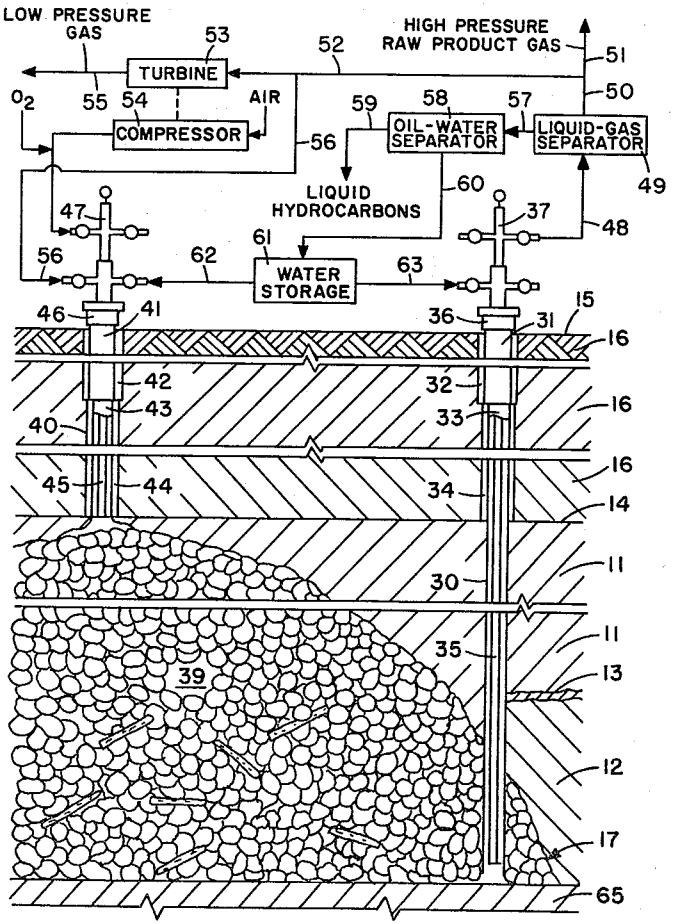
FIG. 3 is a drawing showing the oil-bearing limestone deposit and overlying formations of FIG. 2 and associated surface facilities during a still later stage of the process.

FIG. 3 in the drawing illustrates the oil-bearing limestone seam and overlying formations of FIG. 2 after the oil-bearing limestone has been broken down into the burned out cavity to form rubblized zone 39 as described above. It will be noted that the zone extends vertically over substantially the entire depth of the oil-bearing limestone deposit in the vicinity of borehole 40. Tubing string 45 has been lowered into the borehole to a point near the top of the rubblized zone and connected into Christmas tree 47 to permit the injection of air or other oxygen-containing gas through it. Borehole 30 has been redrilled to the bottom of the rubblized zone, and tubing string 35 has been run into the hole to a point near the bottom and connected to Christmas tree 37 to permit the production of fluids from the rubblized zone to the surface. Surface facilities for use in the liquids recovery operation have been provided.

Following establishment of rubblized zone 39, air or oxygen is injected through tubing string 45 and the oil in the limestone at the top of the zone is ignited. This may be done by using a liquid or gaseous fuel and an electrical ignitor in a manner similar to that described earlier or by means of a hypergolic mixture or the like. Once combustion has been started and a flame front has been established, the air rate is adjusted to cause the front to move downward through the rubblized zone. Experiments have demonstrated that the rate of advance of the front can be readily controlled. At low injection rates, combustible materials tend to diffuse backward into the zone containing oxygen so that the flame front may tend to move in a direction opposite to that in which the injected gases flow. At higher rates, this diffusion does not occur to any significant extent and hence the flame front moves forward with the injected gases. The air rate required for optimum performance in a particular operation will depend in part upon the size and physical characteristics of the rubblized zone, the composition of the oil-bearing limestone within the zone, the composition of the injected gas stream and other factors. By monitoring the produced fluids and observing temperatures at the injection and production boreholes, the rate can normally be adjusted to secure satisfactory movement of the flame front without difficulty. By maintaining suitable back pressure at the production borehole, the pressure within the rubblized zone can be controlled.

As the flame front advances downwardly through the rubblized zone, the heavy oil in the limestone in advance of the flame front is cracked, volatilized and displaced by the products of combustion thereby leaving a coke residue which serves as the fuel for the combustion front. The cracked and volatilized hydrocarbons move downwardly within the rubblized zone and in part condense in the lower portion of the zone. After the combustion front has been established for a substantial period of time, liquid hydrocarbons will begin to accumulate in the lower part of the zone and be produced along with combustion gases through the tubing string 35 in borehole 30. Alternatively, the liquids can be withdrawn through the tubing string and the gases can be taken off through the surrounding annulus. A pump, not shown, can be installed to aid in recovery of the liquids if necessary. The liquids, condensable vapors and gases thus conducted to the surface are withdrawn from the Christmas tree 37. If necessary, water may be injected down the borehole surrounding the tubing string 35 in order to cool the tubing and prevent excessive damage to it. Liquids and gases may also be produced through tubing string 23 in borehole 18, not shown in FIG. 3, which is at the opposite end of the rubblized zone from borehole 30 as can be seen in FIG. 1. The injection of air and production of gases, vapors, and liquids is continued until the combustion front reaches a point near the bottom of the rubblized zone as indicated by a marked reduction in the quantity of liquids produced.

It is normally preferred to initiate combustion at the top of the rubblized zone and drive the flame front downwardly through the zone as described above, however, in some cases it may be advantageous to move the front in the opposite direction or to drive the front diagonally, downwardly or upwardly through the rubblized zone. In most instances movement of the front downwardly through the zone will minimize the amount of liquid hydrocarbons consumed in the process and permit greater liquids recovery than might otherwise be obtained. If passage of the injected fluids downwardly through the zone should be impeded or there are indications that fluids are channeling through the zone, for example, the direction of flow through the rubblized zone can be reversed to alleviate such difficulties. If this is done, it will often be advantageous, at least initially, to inject the combustion air through the annulus of borehole 30, withdraw liquids through tubing string 35 and to take combustion gases and liquids overhead from the zone through borehole 40. Once the difficulty has been overcome, the operation can be resumed in normal manner.

The fluids withdrawn from the production borehole are passed through line 48 to liquid-gas separator 49 where they are cooled sufficiently to condense water in the hydrocarbon liquids present and permit the recovery of heat. The gaseous components normally consisting primarily of carbon monoxide, nitrogen, hydrogen and methane and contain smaller amounts of hydrogen sulfide, hydrogen cyanide, mercaptans, ammonia, sulfur dioxide and the like, are taken off overhead from the separator through line 50. This gas stream, which will normally have a Btu content of from about 75 to about 300 Btu's per standard cubic foot and may be somewhat similar to producer gas, may be passed through line 51 to downstream facilities for the removal of acid gases, ammonia, and other contaminants and then employed as a fuel or further processed to permit the recovery of hydrogen, or use of the gas for the production of synthetic liquids.

It is generally advantageous to pass at least a part of the gas stream recovered from the separator through line 52 to turbine 53 for the recovery of energy which can be used to drive the air compressors 54 employed in carrying out the operation. The low pressure gas discharged from the turbine through line 55 can then be passed to downstream processing facilities. A portion of the high pressure gas stream can also be recycled to the injection borehole through line 56 to aid in the in situ recovery process if desired.

The liquids recovered from the production borehole effluent in liquid-gas separator 49 are passed through line 57 to an oil-water separator 58. Here liquid hydrocarbons produced by the pyrolysis of the heavy oil contained in the limestone in the rubblized zone are separated from the water present. These liquids are recovered from separator 58 through line 59 and may be further processed by conventional methods such as hydrogenation, catalytic reforming, catalytic cracking, coking and the like to yield higher grade products.

The water separated from the liquid stream is withdrawn through line 60 and may be stored in zone 61 for reinjection through line 62 into the injection borehole or through line 63 in the production borehole. It is often advantageous to inject water in this fashion to cool the borehole and prevent damage to the tubing. Furthermore, the water recovered from the rubblized zone will normally contain phenols and other contaminants which will have to be removed before the water can be discharged into streams or the like. The reinjection of water reduces the amount of water for which treatment is required and also decreases the amount of water from surface sources needed to carry out the process.

Although the process of the invention has been described up to this point primarily in terms of the use of air to support combustion within the rubblized zone, it should be understood that oxygen can be employed in lieu of air if desired. The use of oxygen in place of air results in a gas stream which has a low nitrogen content and a higher Btu content than would otherwise be obtained. By introducing substantial quantities of water or steam into the top of the rubblized zone with the air or oxygen, preferably from about 2 to about 10 mols of steam per mol of oxygen, the operation can be carried out to permit the simultaneous production of liquid hydrocarbons produced by the pyrolysis of the heavy oil in the oil-bearing limestone and a gas produced by the gasification of the coke residue formed during pyrolysis. The gas will normally contain carbon monoxide, hydrogen, carbon dioxide, and methane as the principal constituents and will possess a moderate Btu content.

We claim:

1. A process for the recovery of liquid and/or gaseous hydrocarbons from an underground deposit of oil-bearing limestone or dolomite which comprises:

(a) drilling at least two boreholes into the lower portion of said deposit from the earth's surface;

(b) establishing communication between said boreholes within said deposit near the lower boundary of said deposit;

(c) initiating combustion of the oil in said limestone or dolomite near the lower boundary of said deposit;

(d) introducing an oxygen-containing gas into one of said boreholes and withdrawing gaseous combustion products from said oil from another of said boreholes until a sufficient amount of the alkaline earth carbonate in said deposit is decomposed into the alkaline earth oxide occupying a volume of from about 5 to about 30 percent of the volume of said deposit;

(e) introducing water into one of said boreholes in such a manner that said water contacts said alkaline earth oxide without substantial mechanical agitation thereby disintegrating said alkaline earth oxide and forming an aqueous slurry containing alkaline earth hydroxide;

(f) withdrawing said slurry of alkaline earth hydroxide through another of said boreholes thereby creating a cavity having a volume equivalent to from about 5 to about 30 percent of the volume of said deposit;

(g) breaking down into said cavity the oil-bearing limestone or dolomite overlying said cavity until a rubblized zone extending vertically to a point near the upper boundary of said deposit has been formed;

(h) establishing a flame front within said rubblized zone;

(i) driving said flame front through said rubblized zone; and (j) withdrawing liquids and/or gases from said rubblized zone.

2. A process as defined by claim 1 wherein said flame front is driven downwardly through said rubblized zone by injecting an oxygen-containing gas into the upper portion of said zone and withdrawing said liquids and/or gases from said zone at a point near the bottom of said zone.

3. A process as defined by claim 2 wherein said flame front is driven downwardly by injecting said oxygen-containing gas into said upper portion of said zone through a borehole located approximately above the center of said zone.

4. A process as defined by claim 1 wherein said cavity extends over a horizontal area near the bottom of said deposit of from about one-fourth to about two acres.

5. A process as defined by claim 1 wherein said oil-bearing limestone or dolomite is broken down into said cavity by fracturing.

6. A process as defined by claim 1 wherein said oil-bearing limestone or dolomite is broken down into said cavity by means of explosives.

7. A process as defined by claim 1 wherein communication is established between said boreholes by means of hydraulic fracturing.

8. A process as defined by claim 1 wherein said oxygen-containing gas is introduced into one of said boreholes and combustion is initiated in another of said boreholes.

9. A process as defined by claim 1 wherein said oil-bearing limestone or dolomite is broken down into said cavity by detonating a series of explosive charges in a borehole located approximately above the center of said cavity.

10. A process as defined by claim 1 wherein said flame front is driven diagonally upward through said rubblized zone by injecting an oxygen-containing gas into the lower portion of said zone and withdrawing said liquids and/or gases from said zone at a point near the top of said zone.

11. A process as defined by claim 1 wherein said flame front is driven through said rubblized zone by introducing steam and an oxygen-containing gas into said zone behind said flame front.

12. A process as defined by claim 1 wherein said underground deposit comprises Anacacho limestone located in Southwest Texas.

* * * * *